US006336021B1

(12) United States Patent
Nukada

(10) Patent No.: US 6,336,021 B1
(45) Date of Patent: Jan. 1, 2002

(54) ELECTROPHOTOGRAPHIC APPARATUS INCLUDING A PLURALITY OF DEVELOPING AGENT IMAGE FORMING UNITS AND A METHOD OF FORMING AN ELECTROPHOTOGRAPHIC IMAGE

(75) Inventor: Hideki Nukada, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/533,931

(22) Filed: Mar. 23, 2000

(30) Foreign Application Priority Data

Mar. 26, 1999 (JP) ..... 11-083943

(51) Int. Cl.[7] ..... G03G 15/10
(52) U.S. Cl. ..... 399/249; 15/256.51
(58) Field of Search ..... 399/57, 237, 239, 399/240, 249; 15/256.51; 430/117, 118, 260, 261

(56) References Cited

U.S. PATENT DOCUMENTS 4,010,288 A * 3/1977 Souma ..... 430/118
4,482,241 A * 11/1984 Moraw et al. ..... 399/249
4,999,677 A 3/1991 Landa et al. ..... 399/308
5,781,834 A * 7/1998 Teschendorf et al. ..... 399/249
5,899,606 A * 5/1999 Tano et al. ..... 399/239

* cited by examiner

*Primary Examiner*—Fred L Braun
*Assistant Examiner*—Hoan Tran
(74) *Attorney, Agent, or Firm*—Oblon, Spivak, McClelland, Maier & Neustadt, P.C.

(57) ABSTRACT

Disclosed are an electrophotographic apparatus and a method for forming an electrophotographic image, in which a solvent recovery surface is rotated in a direction opposite to a moving direction of an image-holding surface having a liquid developer containing a toner and a solvent supplied thereto at a speed 1 to 4 times as high as the rotating speed of the image-holding surface such that the solvent recovery surface is apart from the image holding surface and in contact with the solvent attached to the image-holding surface at the position where these solvent recovery surface and image-holding surface are closest to each other, so as to remove at least partially the solvent from the image-holding surface.

17 Claims, 4 Drawing Sheets

ELECTROPHOTOGRAPHIC APPARATUS INCLUDING A PLURALITY OF DEVELOPING AGENT IMAGE FORMING UNITS AND A METHOD OF FORMING AN ELECTROPHOTOGRAPHIC IMAGE

CROSS-REFERENCE TO RELATED APPLICATIONS

This application is based upon and claims the benefit of priority from the prior Japanese Patent Application No. 11-083943, filed Mar. 26, 1999, the entire contents of which are incorporated herein by reference.

BACKGROUND OF THE INVENTION

The present invention relates to an electrophotographic apparatus and a method of forming an electrophotographic image, particularly, to an electrophotographic apparatus and a method of forming an electrophotographic image for forming an image by using a liquid developer.

A wet electrophotographic apparatus using a liquid developer containing a toner and a solvent produces various merits that cannot be produced by a dry electrophotographic apparatus using a developing powder. For example, a very fine toner of sub-micron order can be used in a wet electrophotographic apparatus, making it possible to realize a high image quality. Also, since a sufficiently high image density can be obtained with a small amount of the toner, the wet electrophotographic apparatus is advantageous in economy. Also, the apparatus permits achieving a texture equivalent to that of an offset printing. Further, the toner can be fixed to a paper sheet at a relatively low temperature, leading to an energy saving.

However, some essential problems remain unsolved in the wet electrophotographic apparatus. A first problem inherent in the wet electrophotographic apparatus is derived from the use of a petroleum-based solvent, which exhibits a high resistivity or insulating properties, as a carrier solvent of the liquid developer. The problems derived from the use of the particular liquid developer will now be described with reference to FIGS. 1 and 2.

Specifically, FIG. 1 schematically shows a conventional wet color electrophotographic apparatus. FIG. 2 shows in a magnified fashion a part of the color electrophotographic apparatus shown in FIG. 1.

In the wet color electrophotographic apparatus shown in FIG. 1, a photoconductor drum 1 is housed in an enclosure 100. Four sets of chargers 2-n, laser light exposure sections 3-n, developing devices including developing rollers 10-n and solvent recovery devices including solvent recovery rollers 20-n, which correspond to four colors of yellow, magenta, cyan and black, are sequentially arranged about the outer surface of the photoconductor drum 1. In each set of these four colors, the charger, the laser, the developing device, and the solvent recovery device are arranged in the order mentioned in the direction denoted by an arrow 17. For simplification, the transfer section, etc. are omitted from the drawing of FIG. 1. Also, the developing rollers 10-n alone are depicted in the drawing concerning the developing devices. Further, the solvent recovery rollers 20-n and cleaning blades 21-n alone are depicted in the drawing concerning the solvent recovery devices.

As shown in FIG. 2, the developing rollers 10-n are arranged only slightly apart from the photoconductor drum 1. Also, the developing rollers 10-n are partially dipped in a liquid developer housed in a developing agent reservoir (not shown).

The liquid developer is supplied to an image-holding surface 14 of the photoconductor drum 1 by rotating the developing rollers 10-n in a direction opposite to the rotating direction of the photoconductor drum 1, as denoted by arrows in FIG. 2. Incidentally, the drum 1 is rotated in a clockwise direction; whereas, the developing rollers 10-n are rotated in a counterclockwise direction. In short, drum 1 and the rollers 10-n are opposite to each other in the rotating direction, as described above. Since the developing rollers 10-n are rotated in a direction opposite to the rotating direction of the photoconductor drum 1, the liquid developer 11 within the developing agent reservoir is taken up by the developing rollers 10-n so as to be supplied onto the image-holding surface 14 of the photoconductor drum 1.

In this step, a bias voltage of the polarity equal to that of the charged polarity of the toner 12 is applied to the developing rollers 10-n. Also, an electrostatic latent image is formed in advance on the surface of the photoconductor drum 1 by the chargers 2-n and the laser light exposure sections 3-n. Therefore, an electric field is formed in the liquid developer positioned between the photoconductor drum 1 and the developing rollers 10-n to permit a toner 12 to be moved toward the photoconductor drum 1 by electrophoresis. As a result, a developing agent image is formed on the image-holding surface 14 of the photoconductor drum 1 in a pattern corresponding to the electrostatic latent image.

It should be noted that a film of the solvent containing floating toners 12 that do not contribute to the formation of the developing agent image is formed on the image-holding surface 14 having the image of the developing agent formed thereon. The solvent recovery devices including the recovery rollers 20-n and the blades 21-n are mounted for removing the film of the solvent from the image-holding surface 14.

Like the developing rollers 10-n, the recovery rollers 20-n are arranged only slightly apart from the photoconductor drum 1, as shown in FIG. 2. The solvent film is removed from the image-holding surface 14 of the photoconductor drum 1 by rotating the rollers 20-n in a direction equal to the rotating direction of the drum 1 at a speed as high as possible while applying a bias voltage opposite in polarity to the charged polarity of the toner 12 to the recovery rollers 20-n. In other words, the surface of the recovery roller 20-n is moved as fast as possible in the reverse direction to the moving direction of the surface of the photoconductor drum 1 in a closest point to the photoconductor drum 1. To be more specific, the solvent on the image-holding surface 14 and the toner 12 floating in the solvent are taken up by the recovery rollers 20-n by a mechanism opposite to that described previously in conjunction with the developing rollers 10-n so as to be removed from the image-holding surface 14. The solvent and the toner 12 taken up by the recovery rollers 20-n are scraped off by the blades 21-n so as to be recovered in a recovery vessel (not shown).

It was customary in the past to remove the excess solvent on the image-holding surface 14 of the photoconductor drum 1 by the method described above. In the conventional method, however, it was difficult to remove sufficiently the excess solvent on the image-holding surface 14. As a result, a difficulty was brought about that a film of the excess solvent accompanying formation of a developing agent image of a certain color impairs the formation of an electrostatic latent image by irradiation of the image-holding surface 14 with a laser light. In this case, formation of a developing agent image of another color is impaired. Also, in the conventional method, a film of the excess solvent accompanying formation of a developing agent image of a certain color remains on the image-holding surface 14 in forming an image of the developing agent of another color, giving rise to a color mixing. In short, it is difficult to achieve a satisfactory image quality by the conventional method.

In addition, where a large amount of the excess solvent remains on the image-holding surface 14, the solvent excessively permeates into a paper sheet when the developing agent image is transferred onto the paper sheet. As a result, the image quality is lowered and, at the same time, a bad odor is generated from the paper sheet. It should be noted that, in view of environmental issues, release of the solvent from within the electrophotographic apparatus to the outside should be suppressed as much as possible. Under the circumstances, an additional problem is brought about that a mechanism for removing the solvent permeating the paper sheet or for decreasing the amount of the solvent permeating the paper sheet incurs an increased burden.

BRIEF SUMMARY OF THE INVENTION

An object of the present invention is to provide an electrophotographic apparatus and a method of forming an electrophotographic image capable achieving a satisfactory image quality.

Another object of the present invention is to provide an electrophotographic apparatus that permits suppressing the attachment of a solvent to a paper sheet.

Another object of the present invention is to provide a color electrophotographic apparatus that permits achieving a satisfactory image quality.

Further, still another object of the present invention is to provide a color electrophotographic apparatus that permits suppressing the attachment of a solvent to a paper sheet.

According to a first aspect of the present invention, there is provided an electrophotographic apparatus, comprising: an image holder having a movable image-holding surface; a latent image forming device forming a latent image on the image-holding surface, a developing device forming an image of a developing agent on the image-holding surface by supplying a liquid developer containing a toner and a solvent onto the image-holding surface having the latent image formed thereon, and a solvent recovery device including a solvent recovery surface recovering at least partially the solvent from the image-holding surface, the solvent recovery surface being apart from the image-holding surface and in contact with the solvent attached to the image-holding surface in a position closest to the image-holding surface and moving in a direction opposite to a moving direction of the image-holding surface at the position closest to the image-holding surface, the latent image forming device, the developing device and the solvent recovery device facing the image-holding surface in the order mentioned in the moving direction of the image-holding surface; a transfer unit facing the image-holding surface and transferring the developing agent image from the image-holding surface onto a transfer material; and a control unit connected to the solvent recovery device and controlling the moving speed of the solvent recovery surface at 1 to 4 times as high as the moving speed of the image-holding surface.

According to a second aspect of the present invention, there is provided a color electrophotographic apparatus, comprising: an image holder having a movable image-holding surface; a plurality of developing agent image forming units each comprising latent image forming device forming a latent image on the image-holding surface, a developing device forming an image of a developing agent on the image-holding surface by supplying a liquid developer containing a toner and a solvent onto the image-holding surface having the latent image formed thereon, and a solvent recovery device including a solvent recovery surface and recovering at least partially the solvent from the image-holding surface, the solvent recovery surface being apart from the image-holding surface and in contact with the solvent attached to the image-holding surface in a position closest to the image-holding surface, moving in a direction opposite to a moving direction of the image-holding surface at the position closest to the image-holding surface, and having a curvature radius of 5 mm to 11 mm, the latent image forming device, the developing device and the solvent recovery device facing the image-holding surface in the order mentioned in the moving direction of the image-holding surface; a transfer unit facing the image-holding surface and transferring the developing agent image from the image-holding surfaces onto a transfer material; and a control unit connected to the solvent recovery device and controlling the moving speed of the solvent recovery surface at 1 to 4 times as high as the moving speed of the image-holding surface.

According to a third aspect of the present invention, there is provided a method of forming an electrophotographic image, comprising the steps of:

forming an electrostatic latent image on an image-holding surface being moving; supplying a liquid developer containing a toner and a solvent onto the image-holding surface having the latent image formed thereon to form a developing agent image; moving a solvent recovery surface in a direction opposite to the moving direction of the image-holding surface at a speed 1 to 4 times as high as the moving speed of the image-holding surface such that the solvent recovery surface is apart from the image-holding surface and in contact with the solvent attached to the image-holding surface in a position closest to the image-holding surface, thereby recovering at least partially the solvent from the image-holding surface; and transferring the developing agent image from the image-holding surface onto a transferring material.

According to a fourth aspect of the present invention, there is provided a method of forming an electrophotographic image, comprising the steps of forming a first electrostatic latent image on an image-holding surface being moving; supplying a first liquid developer containing a toner and a solvent onto the image-holding surface having the first latent image formed thereon to form a first developing agent image; forming a second electrostatic latent image on the image-holding surface; supplying a second liquid developer differing in color from the first liquid developer and containing a toner and a solvent onto the image-holding surface having the second latent image formed thereon to form a second developing agent image; moving a solvent recovery surface in a direction opposite to the moving direction of the image-holding surface at a speed 1 to 4 times as high as the moving speed of the image-holding surface such that the solvent recovering surface is apart from the image-holding surface and in contact with the solvent attached to the image-holding surface in a position closest to the image-holding surface, thereby recovering at least partially the solvent from the image-holding surface; and transferring at least one of the first and second developing agent images from the image-holding surface onto a transferring material.

In the present invention, a ratio of the moving speed of the solvent recovery surface to the moving speed of the image-holding surface is set to fall within a predetermined range so as to remove sufficiently the excess solvent attached to the image-holding surface. Therefore, if the present invention is applied to the formation of a color electrophotographic image, an electrostatic latent image can be formed clearly on the image-holding surface, making it possible to prevent the color mixing problem satisfactorily.

In the present invention, the excess solvent is removed from the image-holding surface before the transfer step, making it possible to prevent the solvent from being supplied excessively from the image-holder to the transferring unit. This makes it possible to prevent an excessive amount of the solvent from permeating the paper sheet. It follows that the present invention makes it possible to prevent the image quality from being lowered, to prevent an bad odor from being generated from the paper sheet, and to suppress the burden given to a mechanism for removing the solvent permeating the transfer paper sheet or for decreasing the amount of the solvent permeating the transfer paper sheet.

To reiterate, the excess solvent attached to the image-holding surface is removed sufficiently only by setting a ratio of the moving speed of the solvent recovery surface to the moving speed of the image-holding surface to fall within a predetermined range. Therefore, a residual solvent can be removed sufficiently from the image-holding surface without markedly modifying the construction of the conventional electrophotographic apparatus.

In the present invention, it is desirable to set the curvature radius of the solvent recovery surface at the position closest to the image-holding surface at 5 mm to 11 mm. Where the curvature radius is set to meet this condition, the excess liquid developer can be removed more effectively from the image-holding surface. It is also desirable for the distance between the image-holding surface and the solvent recovery surface at the closest position to fall within a range of between 25 $\mu$m and 100 $\mu$m. In this case, the excess liquid developer can be removed more effectively from the image-holding surface without affecting the developing agent image formed on the image-holding surface.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
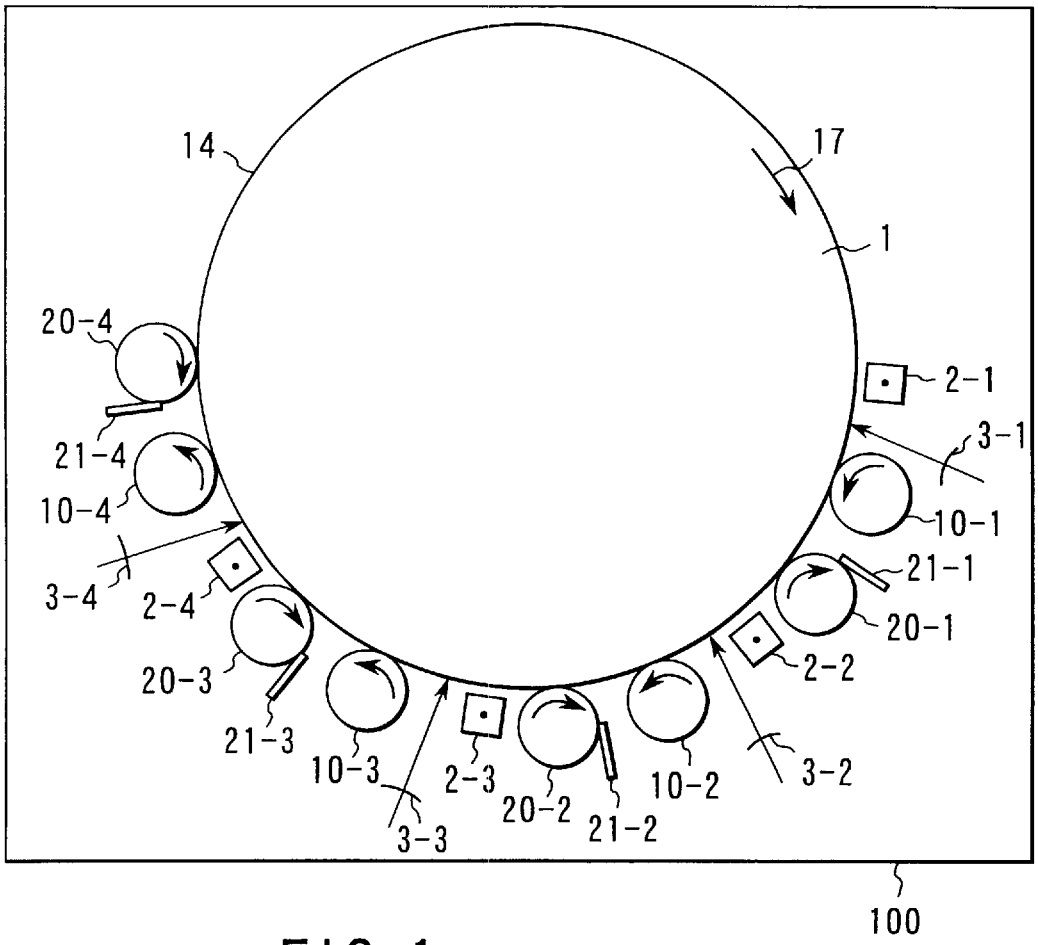
FIG. 1 PRIOR ART
FIG. 1 schematically shows a conventional color electrophotographic apparatus.
Figure 2:
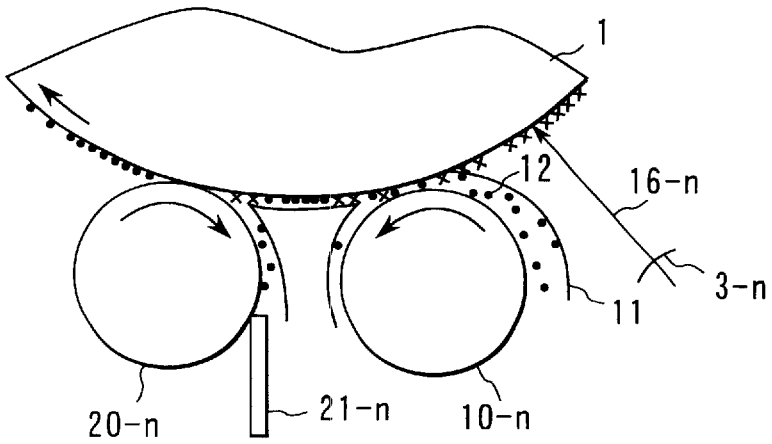
FIG. 2 PRIOR ART
FIG. 2 shows in a magnified fashion a part of the conventional color electrophotographic apparatus shown in FIG. 1.
Figure 3:
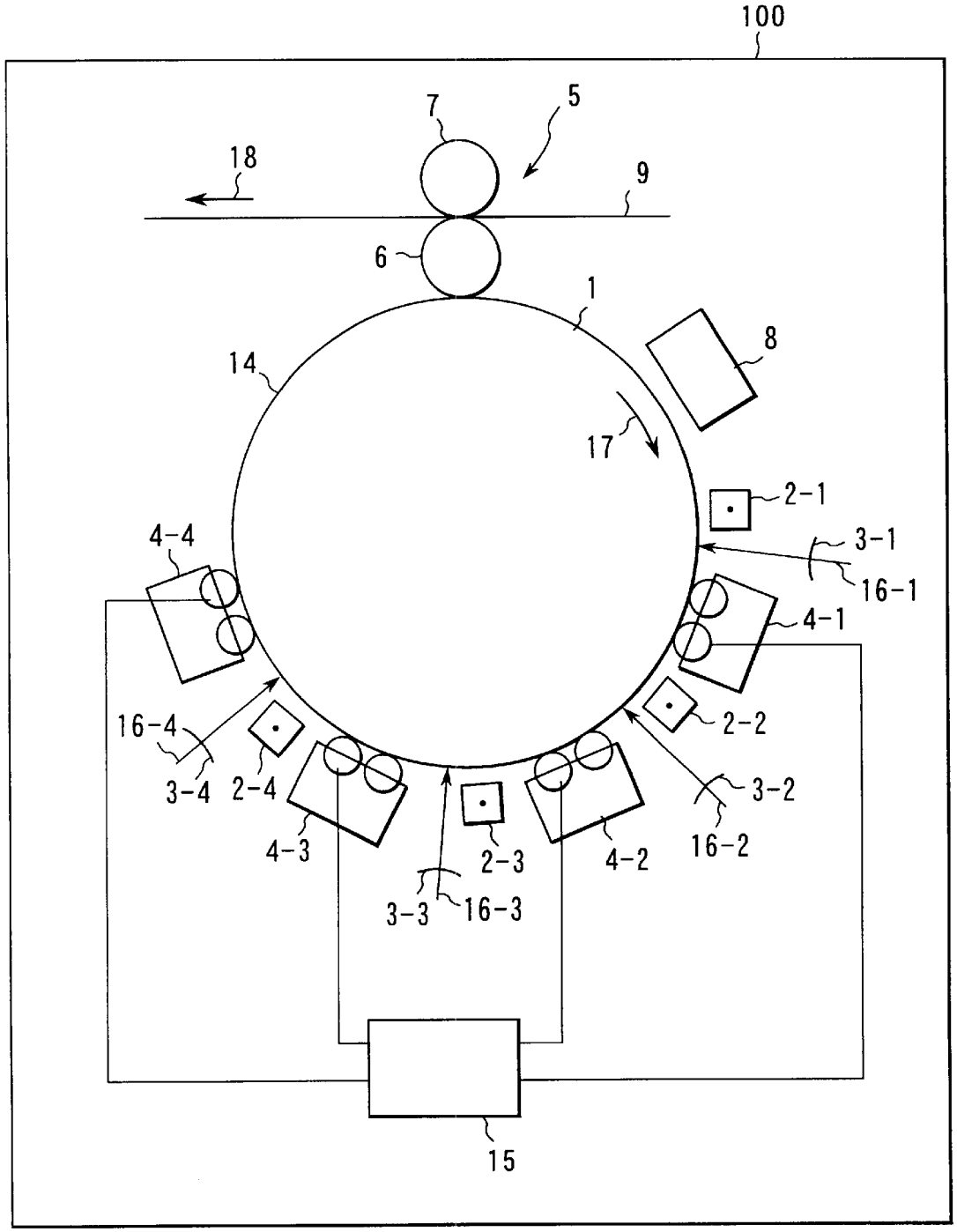
FIG. 3 schematically shows an electrophotographic apparatus according to one embodiment of the present invention.

The present invention will now be described in detail with reference to the accompanying drawings. Specifically, FIG. 3 schematically shows an electrophotographic apparatus according to one embodiment of the present invention. The apparatus shown in FIG. 3 is a color electrophotographic apparatus for forming an electrophotographic image using liquid developers of yellow, magenta, cyan and black.

As shown in FIG. 3, a photoconductor drum 1 acting as an image holder is housed in an enclosure 100. Arranged along the outer surface of the photoconductor drum 1 are a cleaner 8 for cleaning the surface of the photoconductor drum 1, chargers 2-n, developing-recovering devices 4-n, and transfer unit 5. Also, a control unit 15 is connected to each of the developing-recovering devices 4-n. Each constituent of the electrophotographic apparatus shown in FIG. 3 will now be described in detail.

The photoconductor drum 1 comprises a cylindrical conductive substrate and a photosensitive layer formed on the surface of the substrate. The photosensitive layer constitutes a cylindrical image-holding surface 14 containing an organic or an amorphous silicon-based photosensitive material, a charged state of which is changed by, for example, irradiation with light. It is possible for the photosensitive layer to be charged in a predetermined polarity by the chargers 2-n such as corona chargers or scorotron chargers. The photoconductor drum 1 is rotated in a direction denoted by the arrow 17 by a driving mechanism (not shown) so as to permit the image-holding surface 14 to be moved relative to the cleaner 8, the chargers 2-n, the developing-recovering devices 4-n, the transfer unit 5, etc.

An optical unit including a laser (not shown) as an image writing mechanism is arranged in the vicinity of the photoconductor drum 1. The image-holding surface 14 of the photoconductor drum 1 charged in a predetermined polarity by the chargers 2-n is irradiated with laser beams 16-n emitted from the laser and running through window portions 3-n constituting a part of the optical unit. As a result, a surface potential difference is generated between the irradiated portion and the non-irradiated portion to form electrostatic latent images corresponding to the image information for yellow, magenta, cyan and black on the image-holding surface 14. The latent image forming device is constituted by the image writing mechanism and the chargers noted above.

Each of the developing-recovering devices 4-n performs the functions of both the developing device and the solvent recovering device. To be more specific, each of the developing-recovering devices 4-n comprises a developing section for supplying a liquid developer containing a toner and a solvent to the image-holding surface 14 of the photoconductor drum 1 and a solvent recovery section for recovering an excess portion of the liquid developer supplied to the surface of the photoconductor drum 1. These developing-recovering devices 4-n serve to form a developing agent image in a pattern corresponding to the electrostatic latent image on the surface of the photoconductor drum 1 by utilizing the charged polarity of the toner. Also, these developing-recovering devices 4-n and the latent image forming device are alternately arranged along the surface of the photoconductor drum 1. Specifically, developing agent images of yellow, magenta, cyan and black can be successively formed on the image-holding surface 14 in the electrophotographic apparatus shown in FIG. 3.

The control unit 15 is connected to the solvent recovery section of each of the developing-recovering devices 4-n so as to control the number of revolutions or circumferential velocity of the solvent recovery rollers 20-n shown in FIGS. 4A and 4B, which will be described in detail hereinlater. In the electrophotographic apparatus shown in FIG. 3, the number of revolutions or circumferential velocity of the solvent recovery rollers 20-n are controlled on the basis of the number of revolutions or circumferential velocity of the photoconductor drum 1. For example, where the electrophotographic apparatus shown in FIG. 3 is constructed to permit the number of revolutions or circumferential velocity of the photoconductor drum 1 to be changed, the control unit 15 serves to change the number of revolutions or circumferential velocity of the solvent recovery rollers 20-n in accordance with the change in the number of revolutions or circumferential velocity of the photoconductor drum 1. On the other hand, where the photoconductor drum 1 is rotated at a constant number of revolutions or circumferential velocity, the control unit 15 generally maintains constant the number of revolutions or circumferential velocity of the solvent recovery rollers 20-n.

Where the driving source of the photoconductor drum 1 differs from that of the solvent recovery rollers 20-n, the number of revolutions or circumferential velocity of the solvent recovery rollers 20-n are controlled by controlling the power supplied to the solvent recovery rollers 20-n. In this case, the control unit 15 is consisted by an electrical controller for controlling the power supplied to the solvent recovery rollers 20-n.

Where single driving source is used for driving both the photoconductor drum 1 and the solvent recovery rollers 20-n, the number of revolutions or circumferential velocity of the solvent recovery rollers 20-n can be controlled by, for example, permitting the photoconductor drum 1 and the solvent recovery rollers 20-n to be interlocked by using a gear. In this case, the control unit 15 is constituted by a mechanical control unit for mechanically interlocking the photoconductor drum 1 and the solvent recovery rollers 20-n.

The transfer unit 5 comprises a transfer roller 6 arranged in contact with the photoconductor drum 1 and a pressurizing roller 7 for applying pressure to the transfer roller 6. It is possible to apply a predetermined voltage to the transfer roller 6 by a voltage applying unit (not shown). In general, a heater (not shown) is arranged within the transfer roller 6.

Figure 4A:
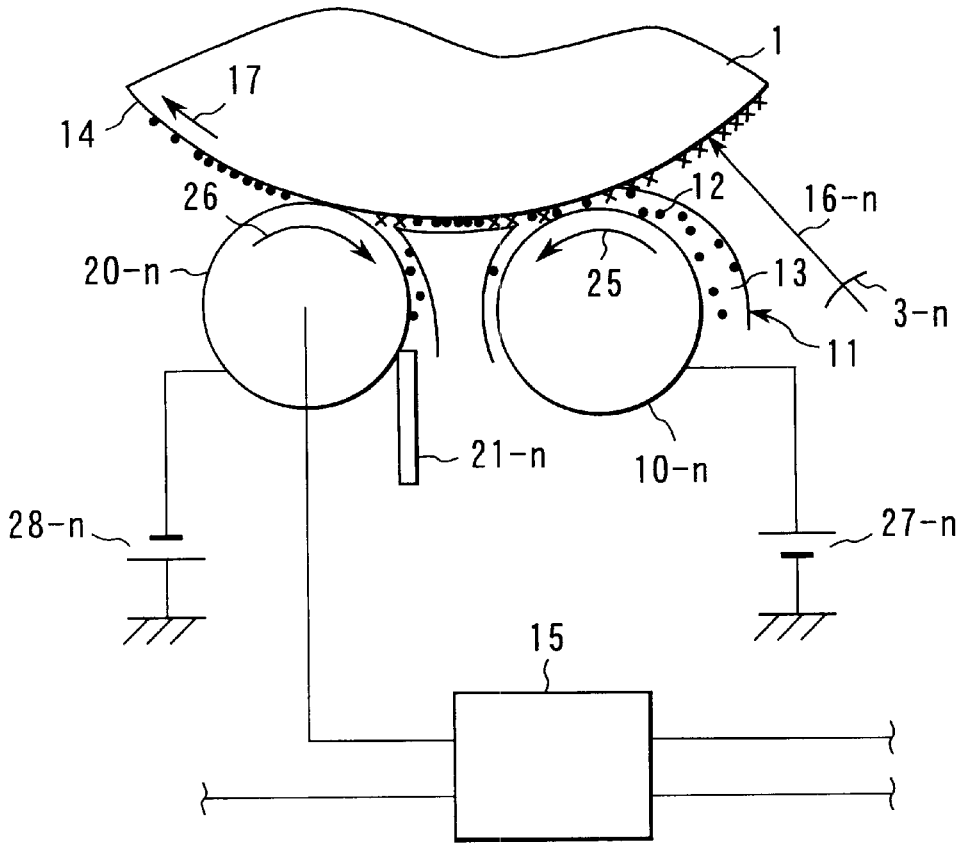
FIG. 4A is a side view showing in a magnified fashion the developing-recovering device included in the electrophotographic apparatus shown in FIG. 3.
Figure 4B:
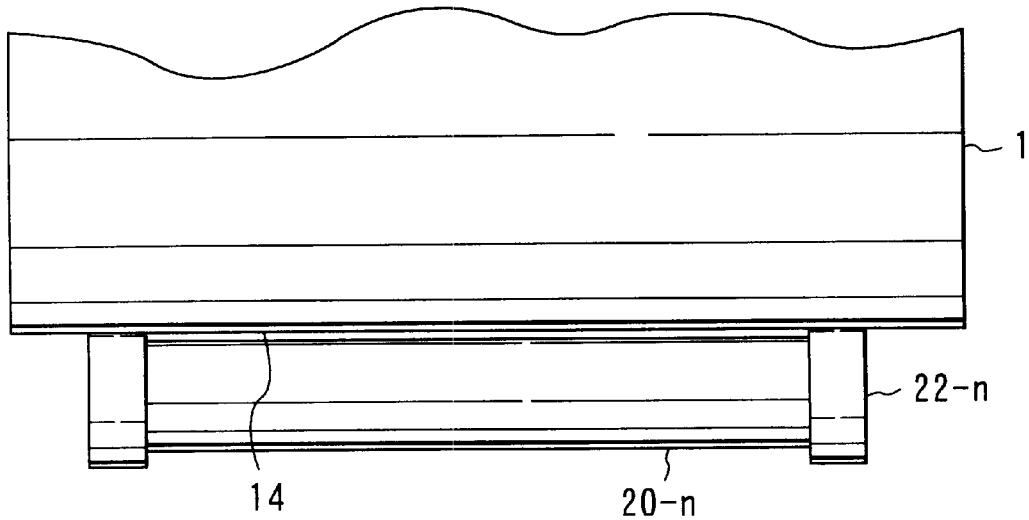
FIG. 4B is a front view showing the developing-recovering device shown in FIG. 4A.

FIGS. 4A and 4B show in detail the developing-recovering devices 4-n of the electrophotographic apparatus shown in FIG. 3. Specifically, FIG. 4A is a side view showing in a magnified fashion the developing-recovering devices 4-n used in the electrophotographic apparatus shown in FIG. 3, and FIG. 4B is a front view of the developing-recovering devices 4-n shown in FIG. 4A. Incidentally, the developing roller 10-n alone is depicted as the developing section in FIGS. 4A and 4B for simplification. Also, the solvent recovery roller 20-n and the cleaning blade 21-n alone are depicted as the solvent recovery section in FIGS. 4A and 4B for simplification.

In general, the developing section comprises a vessel for housing a liquid developer 11, developing rollers 10-n each dipped partially in the liquid developer housed in the vessel, and voltage applying unit 27-n for applying a predetermined bias voltage to the developing rollers 10-n. Also, each of the developing rollers 10-n includes a region made of a conductive material such as SUS, brass or a conductive silicone plastic material and is arranged only slightly apart from the photoconductor drum 1.

On the other hand, each of the solvent recovery rollers 20-n also includes a region made of a conductive material such as SUS, brass or a conductive silicone plastic material and is arranged only slightly apart from the photoconductor drum 1. In general, the solvent recovery section comprises the solvent recovery rollers 20-n, the cleaning blades 21-n, a vessel for housing a solvent 13 recovered from the surface of the photoconductor drum 1, a rotating mechanism (not shown) for rotating the solvent recovery rollers 20*n*, a voltage applying unit 28-n for applying a predetermined bias voltage to the solvent recovery rollers 20-n, and rollers 22-n shown in FIG. 4B.

The rollers 22-n are rotatably mounted to both edge portions of each of the solvent recovery rollers 20-n. The rollers 22-n, which are arranged coaxial with the solvent recovery rollers 20-n, are pressed against the photoconductor drum 1 by a press mechanism (not shown). Also, the rollers 22-n have a diameter slightly larger than that of the solvent recovery rollers 20-n. These rollers 22-n roll along the periphery of the photoconductor drum 1 to maintain constant the distance between the solvent recovery rollers 20-n and the photoconductor drum 1. Incidentally, in the closest point, the rollers 22-n are rotated in the forward direction to the rotating direction of the photoconductor drum 1. On the other hand, in the closest point, the surface of the solvent recovery rollers 20-n moves in the reverse direction to the moving direction of the surface of the photoconductor drum 1. It follows that the rollers 22-n differ from the solvent recovery rollers 20-n in the rotating direction. Similar rollers are also mounted to the developing rollers 10-n. The rollers for the developing rollers 10-n and the developing rollers 10-n themselves are rotated in the same direction, as denoted by an arrow 25.

The process for forming an electrophotographic image by using the electrophotographic apparatus shown in FIG. 3 will now be described.

Specifically, the process for forming an electrophotographic image is performed while continuously rotating the photoconductor drum 1 in a direction denoted by, for example, the arrow 17. In the first step, the image-holding surface 14 cleaned by the cleaner 8 is moved to face the charger 2-1 in accordance with rotation of the photoconductor drum 1 so as to be uniformly charged either positive or negative.

Then, the image-holding surface 14 charged by the charger 2-1 is moved to face the window portion 3-1 in accordance with rotation of the photoconductor drum 1 so as to be irradiated with a laser beam 16-1 emitted from the laser (not shown) and running through the window portion 3-1. In this step, the image-holding surface 14 is selectively irradiated with the laser beam 16-1 to conform with a yellow image information. As a result, the exposed portion of the image-holding surface 14 is destaticized to form an electrostatic latent image corresponding to the yellow image information on the image-holding surface 14.

After formation of the electrostatic latent image corresponding to the yellow image information, the image-holding surface 14 is moved to face the developing-recovering device 4-1 in accordance with rotation of the photoconductor drum 1. That portion of the developing-recovering device 4-1 which is positioned on the side of the charger 2-1 corresponds to a developing section. Also, that portion of the developing-recovering device 4-1 which is positioned on the side of the charger 2-2 corresponds to a solvent recovery section. It follows that a liquid developer containing a yellow toner and a solvent is supplied first to developing section of the image-holding surface 14 moved to face the developing-recovering device 4-1 and, then, an excess solvent is removed in the solvent recovery section. Since the toner is charged either positive or negative, a yellow developing agent image is formed on the image-holding surface 14 by the treatment described above.

The step for forming the developing agent image will now be described more in detail with reference to FIG. 4A. As described above, the image-holding surface 14 having the yellow electrostatic latent image formed thereon is moved to face the developing-recovering device 4-1 in accordance with rotation of the photoconductor drum 1. It should be noted that the developing roller 10-1 is rotated in a counterclockwise direction as denoted by the arrow 25 in contrast to the photoconductor drum 1 that is rotated in the clockwise direction as denoted by the arrow 17. Namely, in the closest point of them, the moving direction of the surface of the developing roller 10-1 is the same as that of the drum 1. Since the developing roller 10-1 and the photoconductor drum 1 are rotated in opposite directions, the liquid developer 11 housed in a vessel (not shown), said developing agent being adsorbed on the surface of the developing roller 10-1, is taken up by the developing roller 10-1 so as to be supplied into the gap between the photoconductor drum 1 and the developing roller 10-1. Incidentally, the liquid developer 11 contains a toner in an amount of, for example, 1% by weight to 10% by weight, and a solvent. It is possible to use a petroleum-based solvent having a viscosity lower than that of water and a high resistivity to allow the solvent to exhibit insulating properties, said petroleum-based solvent containing as main components organic compounds having 13 or 14 carbon atoms.

A predetermined bias voltage of the polarity equal to that of the charged toner 12, i.e., a positive voltage in FIG. 4A, is applied from the power source 27-1 to the developing roller 10-1. Therefore, an electric field is formed within the liquid developer 11 positioned in the gap noted above to permit the toner 12 to be moved toward the photoconductor drum 1 by electrophoresis. As a result, a yellow developing agent image is formed in a pattern conforming with the yellow electrostatic latent image on the surface of the photoconductor drum 1.

An excess developing agent 11 remains on the image-holding surface 14 of the photoconductor drum 1 having the yellow developing agent image formed thereon. The excess developing agent 11 is recovered by the developing-recovering device 4-1 as follows. It should be noted that the solvent recovery roller 20-1 is rotated in a direction denoted by the arrow 26 in accordance with rotation of the photoconductor drum 1 in the direction denoted by the arrow 17. In other words, the moving direction of the surface of the recovery roller 20-1 is opposite to the moving direction of the surface of the drum 1 in the closest point. The number of revolutions or circumferential velocity of the solvent recovery roller 20-1 is controlled to fall within a predetermined range by the control unit shown in FIG. 3, which is connected to the solvent recovery section.

A predetermined bias voltage of a polarity (negative voltage in FIG. 4A) opposite to that of the charged toner is applied from the power source 28-1 to the solvent recovery roller 20-1. As a result, the excess liquid developer 11 on the surface of the photoconductor drum 1 is removed by adsorbing force to the surface and the electrostatic attractive force. The liquid developer 11 attached to the solvent recovery roller 20-n is scratched off by the blade 21-1 so as to be recovered in a vessel (not shown).

After formation of the yellow developing agent image on the image-holding surface 14, developing agent images of magenta, cyan and black are successively formed by a method similar to that described above. Then, a transfer step is carried out as follows.

In the first step, a paper sheet 9 is inserted into the gap between the transfer roller 6 and the pressurizing roller 7. The transfer roller 6 is heated in advance to a relatively low temperature, e.g., 40 to 60° C., by a heater (not shown). Then, the photoconductor drum 1, the transfer roller 6 and the pressurizing roller 7 are rotated to bring the developing agent image formed on the image-holding surface 14 into contact with the surface of the transfer roller 6. At the same time, a voltage of a polarity opposite to the charged toner is applied to the transfer roller 6. As a result, the developing agent image is transferred from the image-holding surface 14 of the photoconductor drum 1 onto the transfer roller 6 by the electrostatic attractive force between the developing agent image and the transfer roller 6.

The developing agent image transferred onto the transfer roller 6 is moved in accordance with rotation of the transfer roller 6 so as to be brought into contact with the paper sheet 9. Since pressure is applied from the pressurizing roller 7 to the transfer roller 6 in this step, the developing agent image is transferred from the surface of the transfer roller 6 onto the paper sheet 9. The paper sheet 9 is moved in a direction denoted by an arrow 18 in accordance with rotation of the transfer roller 6, with the result that the developing agent image transferred onto the transfer roller 6 is consecutively transferred onto the paper sheet 9. In this fashion, a full color electrophotographic image is formed on the paper sheet 9.

In the present invention, the circumferential velocity of the solvent recovery rollers 20-n is controlled to fall within a range of between 1 and 3 times as high as the circumferential velocity of the photoconductor drum 1 so as to achieve a high image quality and to suppress attachment of the solvent to the paper sheet. The particular technical idea of the present invention is based on the phenomenon found by the present inventors, said phenomenon overthrowing the conventional common sense.

It was customary in the past to rotate the solvent recovery rollers 20-n at a speed as high as possible so as to recover sufficiently the excess liquid developer 11. In other words, it was a common sense in the past to rotate the solvent recovery rollers 20-n at a speed as high as possible for sufficiently recovering the excess liquid developer 11.

However, the present inventors have looked into the relationship between the recovery efficiency of the excess liquid developer 11 and the rotating speed of the solvent recovery rollers 20-n, finding that the liquid developer 11 can be recovered more efficiently in the case where the solvent recovery rollers 20-n are rotated at a speed lower than the speed at which the solvent recovery rollers 20-n were rotated in the past. In other words, it has been found that the recovery efficiency of the liquid developer 11 is lowered if the circumferential velocity of the solvent recovery rollers 20-n exceeds a predetermined value.

Figure 5:
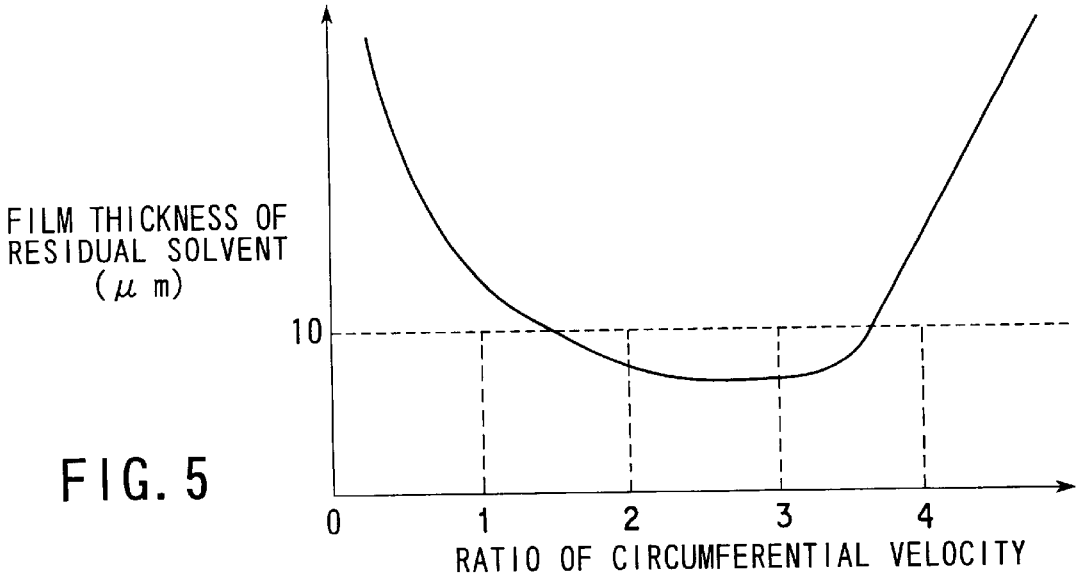
FIG. 5 is a graph showing the relationship between a ratio in circumferential velocity of the photoconductor drum to the solvent recovery roller and a recovery efficiency of the liquid developer in the electrophotographic apparatus according to one embodiment of the present invention.

FIG. 5 is a graph showing the recovery efficiency of the liquid developer 11 relative to the ratio of the circumferential velocity of the solvent recovery rollers 20-n to the circumferential velocity of the photoconductor drum 1. In the graph of FIG. 5, the ratio of the circumferential velocity of the solvent recovery rollers 20-n to the circumferential velocity of the photoconductor drum 1 is plotted on the abscissa. On the other hand, the film thickness of the solvent 13 remaining on the surface of the photoconductor drum 1 is plotted on the ordinate. For obtaining the data given in FIG. 5, used were the photoconductor drum 1 having a diameter of 150 mm and the solvent recovery rollers 20-n each having a diameter of 17 cm. During the test, the distance between the solvent recovery rollers 20-n and the photoconductor drum 1 was set at 50 $\mu$m.

As shown in FIG. 5, the thickness of the residual solvent film is initially decreased with increase in the circumferential velocity ratio from zero. However, the thickness of the residual solvent film is increased, if the circumferential velocity ratio exceeds a certain value. In other words, the experimental data given in FIG. 5 support that a sufficiently high recovery efficiency can be achieved by controlling the ratio in the circumferential velocity of the solvent recovery rollers 20-n to the photoconductor drum 1.

The excess solvent remaining on the image-holding surface 14 after passage of the image-holding surface 14 through the developing-recovering devices 4-n variously affects the subsequent process. For example, if the solvent film is unduly thick, the amount of the residual toner floating in the solvent is increased, giving rise to a color mixing problem in the subsequent developing process of another color. Also, if a large amount of the excess solvent remains on the image-holding surface 14, the toner image is likely to flow in the step of transferring the developing agent image from the image-holding surface 14 onto an intermediate transfer body or directly onto a paper sheet so as to impair the image quality. As described above, it is undesirable in terms of the image quality, etc. for an excessively large amount of the solvent to remain on the image-holding surface 14. It has been confirmed by an experiment for transferring a developing agent image by utilizing an electric field that the transfer efficiency is markedly improved if a suitable amount of the solvent remains on the image-holding surface 14. In other words, there is an optimum value in the thickness of the residual solvent layer, and it is necessary to control the thickness of residual solvent layer at the optimum value in order to obtain a high image quality. The present inventors have experimentally confirmed that the upper limit in the optimum value of the residual solvent layer thickness is about 10 $\mu$m. It has also been found that the lower limit in the optimum value is lower than the lowest value shown in FIG. 5.

As described above, the thickness of the residual solvent film should be 10 $\mu$m or less in order to achieve a high image quality. To be more specific, the circumferential velocity of the solvent recovery rollers 20-n should be equal to or not higher than 4, preferably 1.2 to 3.7, times as high as the circumferential velocity of the photoconductor drum 1 in order to remove sufficiently the solvent 13, i.e., the excess liquid developer 11, from the surface of the photoconductor drum 1 so as to achieve a high image quality.

Figure 6:
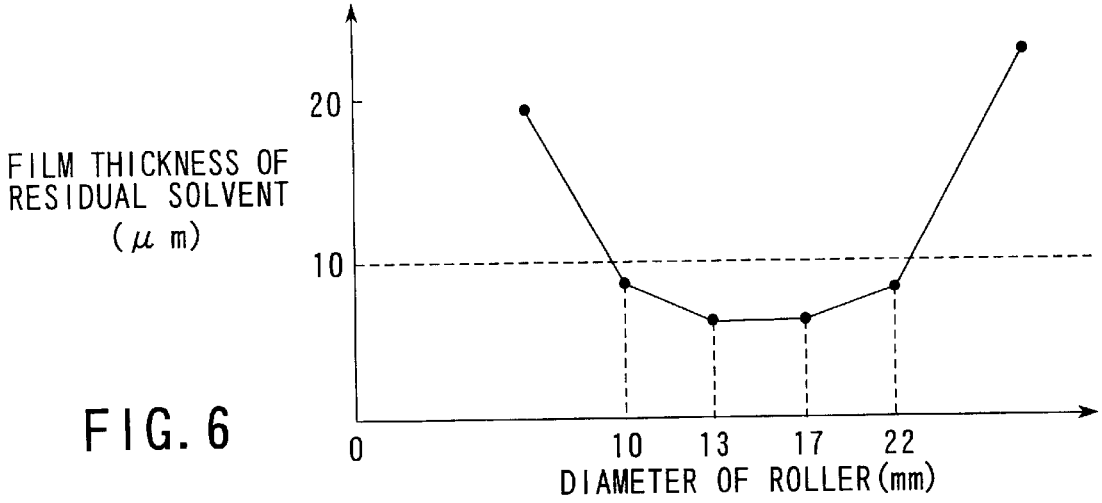
FIG. 6 is a graph showing the relationship between a diameter of the solvent recovery roller and a recovery efficiency of the liquid developer used in the electrophotographic apparatus according to one embodiment of the present invention.

The recovery efficiency of the liquid developer 11, which depends on the ratio in the circumferential velocity of the solvent recovery rollers 20-n to the photoconductor drum 1 as described above, also depends on, for example, the diameter of the solvent recovery rollers 20-n, as shown in FIG. 6.

Specifically, FIG. 6 is a graph showing the relationship between the diameter of the solvent recovery rollers 20-n and the recovery efficiency of the liquid developer 11. In the graph of FIG. 6, the diameter of the solvent recovery rollers 20-n is plotted on the abscissa, with the film thickness of the solvent 13 remaining on the surface of the photoconductor drum 1 being plotted on the ordinate. In obtaining the data given in FIG. 6, used was the photoconductor drum 1 having a diameter of 20 mm. The ratio in the circumferential velocity of the solvent recovery rollers 20-n to the photoconductor drum 1 was set at 2. Further, the distance between the solvent recovery rollers 20-n and the photoconductor drum 1 was set at 50 $\mu$m.

As shown in FIG. 6, the thickness of the residual solvent film is initially decreased with increase in the diameter of the solvent recovery rollers 20-n. However, the thickness of the residual solvent film is increased, if the diameter of the solvent recovery rollers 20-n exceeds a certain value. As already described, it is necessary in general to set the thickness of the residual solvent film at 10 $\mu$m or less in order to achieve a high image quality. Therefore, the excess liquid developer 11 can be removed more efficiently from the surface of the photoconductor drum 1 by setting the diameter of the solvent rollers 20-n to fall within a range of between 10 mm and 22 mm, as shown in FIG. 6.

The recovery efficiency of the excess liquid developer 11 from the image-holding surface 14 is affected by not only the diameter of the solvent recovery rollers 20-n but also the diameter of the photoconductor drum 1. However, the influences given by the diameter of the photoconductor drum 1 to the recovery efficiency are smaller than those given by the diameter of the solvent recovery rollers 20-n to the recovery efficiency. In general, if the diameter of the photoconductor drum 1 is about 100 mm to 270 mm, the excess liquid developer 11 can be efficiently removed from the image-holding surface 14 by setting the diameter of the solvent recovery rollers 20-n to fall within a range of between 10 mm and 22 mm.

Figure 7:
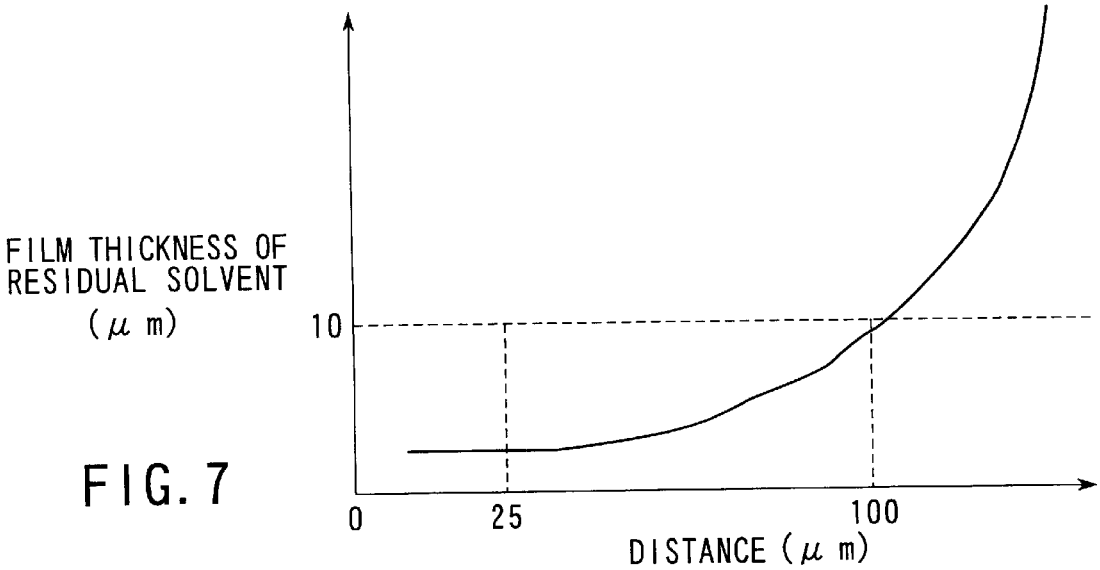
FIG. 7 is a graph showing the relationship between the distance of the solvent recovery roller from the photoconductor drum and a recovery efficiency of the liquid developer used in the electrophotographic apparatus according to one embodiment of the present invention.

The recovery efficiency of the liquid developer 11 is also dependent on the distance between the photoconductor drum 1 and the solvent recovery rollers 20-n, as apparent from FIG. 7. Specifically, FIG. 7 is a graph showing the recovery efficiency of the liquid developer 11 relative to the distance between photoconductor drum 1 and the solvent recovery rollers 20-n. In the graph of FIG. 7, the distance between the photoconductor drum 1 and the solvent recovery rollers 20-n is plotted on the abscissa, with the thickness of the solvent 13 remaining on the surface of the photoconductor drum 1 being plotted on the ordinate. In obtaining the data given in FIG. 7, used were the photoconductor drum 1 having a diameter of 150 mm and the solvent recovery rollers 20-n each having a diameter of 17 mm. Also, the ratio in the circumferential velocity of the solvent recovery rollers 20-n to the photoconductor drum 1 was set at 2.

As shown in FIG. 7, the thickness of the residual solvent film can be decreased by decreasing the distance between the photoconductor drum 1 and the solvent recovery rollers 20-n. As already pointed out, it is necessary to set the thickness of the residual solvent film at about 10 $\mu$m in order to achieve a high image quality. Therefore, the excess liquid developer 11 can be removed more effectively from the surface of the photoconductor drum 1 by setting the distance between the photoconductor drum 1 and the solvent recovery rollers 20-n not to exceed 100 μm, as apparent from FIG. 7.

However, where the solvent recovery rollers 20-n are positioned unduly close to the photoconductor drum 1, even the developing agent image formed on the image-holding surface 14 of the photoconductor drum 1 tends to be scraped off. The present inventors have experimentally confirmed that a detrimental effect given to the developing agent image formed on the image-holding surface 14 can be prevented by setting the distance between the photoconductor drum 1 and the solvent recovery rollers 20-n at 25 μm or more. It follows that the excess liquid developer 11 can be removed more effectively from the surface of the photoconductor drum 1 without adversely affecting the developing agent image formed on the surface of the photoconductor drum 1 by setting the distance between the photoconductor drum 1 and the solvent recovery rollers 20-n to fall within a range of between 25 μm and 100 μm.

In the process of forming an electrophotographic image described above, the developing agent images of different colors are superposed one upon the other on the image-holding surface 14 of the photoconductor drum 1, followed by transferring the superposed developing agent images onto the paper sheet 9. The particular process makes it possible to obtain high quality images at a high speed. Needless to say, however, it is also possible in the present invention to employ a process of transferring a developing agent image of each color onto the paper sheet 9.

Also, in the transfer process described above, an electrostatic force is utilized for the transfer of the developing agent image from the photoconductor drum 1 onto the transfer roller 6, and pressure is applied from the pressurizing roller 7 to the transfer roller 6 for the transfer of the developing agent image from the transfer roller 6 onto the paper sheet 9. However, any method can be employed as far as the developing agent image can be transferred onto the paper sheet 9 while avoiding attachment of the solvent to the paper sheet 9. In other words, any of the electrostatic force and the pressure application can be employed for the transfer of the developing agent image.

In the case of using a liquid developer, the developing agent image can be fixed in general to the paper sheet 9 without employing heating. However, the image can be thermally fixed by heating, for example, the transfer roller 6. The particular image forming process is disclosed in, for example, U.S. Pat. No. 5,570,173.

In the embodiment described above, the solvent recovering device includes the solvent recovery rollers 20-n. However, it is also possible to employ a solvent recovering device of another construction. For example, it is possible to use an endless belt in place of the solvent recovery rollers 20-n. In this case, the excess liquid developer can be removed sufficiently from the image-holding surface by setting the velocity on the surface of the belt at 1 to 4 times as high as the velocity of the image-holding surface 14 of the photoconductor drum 1.

In the embodiment described above, a color electrophotographic image is formed by using a yellow liquid developer, a magenta liquid developer, a cyan liquid developer, and a black liquid developer. However, it is also possible to form a color electrophotographic image by using liquid developers of other colors. Also, the electrophotographic image formed need not be colored. In other words, it is also possible to form a monochromatic electrophotographic image.

As described above, the velocity of the solvent recovery surface is controlled in the present invention at 1 to 3 times as high as that of the image-holding surface so as to remove sufficiently the excess solvent attached to the image-holding surface. Therefore, where an electrostatic latent image corresponding to image information of a certain color is formed on the image-holding surface having a developing agent image of another color formed in advance, it is substantially impossible for the laser beam to be reflected by the solvent attached to the image-holding surface. It follows that a satisfactory electrostatic latent image can be formed on the image-holding surface in the present invention.

It should also be noted that the excess liquid developer remaining on the image-holding surface can be sufficiently removed by the solvent recovering device, with the result that a developing agent of a certain color is not mixed with a developing agent of another color on the image-holding surface. In other words, a color mixing can be prevented in the present invention.

Further, in the present invention, the excess solvent is removed from the image-holding surface before the transfer step, with the result that it is impossible for the solvent to be supplied excessively from the image-holding surface to the transfer unit. Naturally, permeation of an excessive amount of the solvent into the transfer material can be prevented. It follows that the image quality is prevented from being lowered in the transfer step in the present invention. In addition, since it is possible to prevent an excessive amount of the solvent from permeating the transfer material, it is possible to prevent a bad odor from being generated from the transfer material. It is also possible to lessen the burden of the mechanism for removing the solvent permeating the transfer material or for decreasing the amount of the solvent permeating the transfer mechanism.

What should also be noted is that the excess solvent attached to the image-holding surface can be sufficiently removed by using a control unit serving to set the velocity of the solvent recovery surface at 1 to 4 times as high as that of the image-holding surface. In other words, the residual solvent can be removed sufficiently from the image-holding surface in the present invention without markedly modifying the construction of the conventional electrophotographic apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color electrophotographic apparatus, comprising:

an image holder having a movable image-holding surface;

a plurality of developing agent image forming units each comprising a latent image forming device configured to form a latent image on the image-holding surface, a developing device configured to form an image of a developing agent on the image-holding surface by supplying a liquid developer containing a toner and a solvent onto the image-holding surface having the latent image formed thereon, and a solvent recovery device including a solvent recovery surface and configured to recover at least partially the solvent from the image-holding surface, the solvent recovery surface being apart from the image-holding surface and in contact with the solvent attached to the image-holding surface in a position closest to the image-holding surface and moving in a direction opposite to a moving direction of the image-holding surface at the position closest to the image-holding surface, the latent image forming device, the developing device and the solvent recovery device facing the image-holding surface in the order mentioned in the moving direction of the image-holding surface;

a transfer unit facing the image-holding surface and configured to transfer the developing agent images from the image-holding surface onto a transfer material; and a control unit connected to each of the solvent recovery devices and configured to control each moving speed of the solvent recovery-surfaces at 1 to 4 times as high as the moving speed of the image-holding surface.

2. An apparatus according to claim 1, wherein each of the solvent recovery devices comprises a roller having the solvent recovery surface.

3. An apparatus according to claim 2, wherein each of the solvent recovery devices further comprises a removing member configured to remove the solvent attached to the solvent recovery surface.

4. An apparatus according to claim 1, wherein the image holder is a photoconductor drum.

5. An apparatus according to claim 1, wherein the latent image is an electrostatic latent image.

6. An apparatus according to claim 5, wherein each of the solvent recovery devices further comprises a voltage application mechanism configured to apply a voltage of a polarity opposite to the charged polarity of the toner to the solvent recovery surface.

7. An apparatus according to claim 1, wherein the plural developing agent image forming units consists of four developing agent image forming units forming a yellow developing agent image, a magenta developing agent image, a cyan developing agent image and a black developing agent image, respectively.

8. An apparatus according to claim 1, wherein the developing agent image forming units are configured to form a composite color image comprising the developing agent images on the image-holding surface, and the transfer unit is configured to transfer the composite color image from the image-holding surface onto the transfer material.

9. A color electrophotographic apparatus, comprising:

an image holder having a movable image-holding surface;

a plurality of developing agent image forming units each comprising a latent image forming device configured to form a latent image on the image-holding surface, a developing device configured to form an image of a developing agent on the image-holding surface by supplying a liquid developer containing a toner and a solvent onto the image-holding surface having the latent image formed thereon, and a solvent recovery device including a solvent recovery surface and configured to recover at least partially the solvent from the image-holding surface, the solvent recovery surface being apart from the image-holding surface and in contact with the solvent attached to the image-holding surface in a position closest to the image-holding surface, moving in a direction opposite to a moving direction of the image-holding surface at the position closest to the image-holding surface, and having a curvature radius of 5 mm to 11 mm, the latent image forming device, the developing device and the solvent recovery device facing the image-holding surface in the order mentioned in the moving direction of the image-holding surface;

a transfer unit facing the image-holding surface and configured to transfer the developing agent images from the image-holding surface onto a transfer material; and a control unit connected to the solvent recovery device and configured to control the moving speed of the solvent recovery surface at 1 to 4 times as high as the moving speed of the image-holding surface.

10. An apparatus according to claim 9, wherein the image-holding surface has a curvature radius of 50 mm to 135 mm at the position closest to the solvent recovery surface.

11. An apparatus according to claim 10, wherein the distance between the solvent recovery surface and the image-holding surface is 25 $\mu$m to 100 $\mu$m where these solvent recovery surface and image-holding surface are positioned closest to each other.

12. An apparatus according to claim 11, wherein the image holder is a photoconductor drum and the solvent recovery device comprises a roller having the solvent recovery surface.

13. An apparatus according to claim 9, wherein the distance between the solvent recovery surface and the image-holding surface is 25 $\mu$m to 100 $\mu$m where these solvent recovery surface and image-holding surface are positioned closest to each other.

14. An apparatus according to claim 9, therein the developing agent image forming units are configured to form a composite color image comprising the developing agent images on the image-holding surface, and the transfer unit is configured to transfer the composite color image from the image-holding surface onto the transfer material.

15. A color electrophotographic apparatus, comprising:

an image holder having a movable image-holding surface;

a plurality of developing agent image forming units each comprising a latent image forming device configured to form a latent image on the image-holding surface, a developing device configured to form an image of a developing agent on the image-holding surface by supplying a liquid developer containing a toner and a solvent onto the image-holding surface having the latent image formed therein, and a solvent recovery device including a solvent recovery surface and configured to recover at least partially the solvent from the image-holding surface, the solvent recovery surface being apart from the image-holding surface by 25 $\mu$m 100 $\mu$m and in contact with the solvent attached to the image-holding surface in a position closest to the image-holding surface and moving in a direction opposite to a moving direction of the image-holding surface at the position closest to the image-holding surface, the latent image forming device, the developing device and the solvent recovery device facing the image-holding surface in the order mentioned in the moving direction of the image-holding surface;

a transfer unit facing the image-holding surface and configured to transfer the developing agent images from the image-holding surfaces onto a transfer material; and a control unit connected to each of the solvent recovering device and configured to control each moving speed of the solvent recovery surfaces at 1 to 4 times as high as the moving speed of the image-holding surface.

16. An apparatus according to claim 15, wherein the developing agent image forming units are configured to form a composite color image comprising the developing agent images on the image-holding surface, and the transfer unit is configured to transfer the composite color image from the image-holding surface onto the transfer material.

17. A method of forming an electrophotographic image, comprising:

forming a first electrostatic latent image on an image-holding surface being moving;

supplying a first liquid developer containing a first toner and a first solvent onto the image-holding surface having the first latent image formed thereon to form a first developing agent image containing the first toner;

moving a first solvent recovery surface in a direction opposite to the moving direction of the image-holding surface at a speed 1 to 4 times as high as the moving speed of the image-holding surface such that the first solvent recovery surface is apart from the image-holding surface and in contact with the first solvent attached to the image-holding surface in a position closest to the image-holding surface, thereby recovering at least partially the solvent from the image-holding surface;

forming a second electrostatic latent image on the image-holding surface being moving and having the first solvent recovered at least partially therefrom;

supplying a second liquid developer containing a second toner and a second solvent onto the image-holding surface having the second electrostatic latent image formed thereon to form a composite color image comprising the first developing agent image and a second developing agent image containing the second toner;

moving a second solvent recovery surface in a direction opposite to the moving direction of the image-holding surface at a speed 1 to 4 times as high as the moving speed of the image-holding surface such that the second solvent recovery surface is apart from the image-holding surface and in contact with the second solvent attached to the image-holding surface in a position closest to the image-holding surface, thereby recovering at least partially the second solvent from the image-holding surface; and transferring the composite color image from the image-holding surface onto a transferring material.

* * * * *